United States Patent [19]

Rogers

[11] 4,279,122

[45] Jul. 21, 1981

[54] METHOD OF MAKING CHAIN

[75] Inventor: James B. Rogers, Lakeland, Fla.

[73] Assignee: Dresser Industries, Inc., Dallas, Tex.

[21] Appl. No.: 77,081

[22] Filed: Sep. 19, 1979

[51] Int. Cl.[3] ..... B21L 5/02

[52] U.S. Cl. ..... 59/10; 59/30; 249/57; 425/DIG. 34

[58] Field of Search ..... 59/1, 10, 30, 35 R; 164/69, 70; 425/DIG. 34; 249/57

[56] References Cited

U.S. PATENT DOCUMENTS

| | | | |
|---|---|---|---|
| 671,038 | 4/1901 | Wesner | 59/10 |
| 895,649 | 8/1908 | Lewis | 59/10 |
| 3,427,801 | 2/1969 | McLeish | 59/1 |

FOREIGN PATENT DOCUMENTS

| | | | |
|---|---|---|---|
| 339021 | 9/1903 | France | 59/35 |
| 219389 | 7/1924 | United Kingdom | 59/10 |

*Primary Examiner*—Howard N. Goldberg

*Attorney, Agent, or Firm*—Ward, Lalos, Leeds, Keegan & Lett

[57] ABSTRACT

A method of making a chain generally consisting of forming at least two links integrally so that the two links are interlocked and are joined together and then severing the links along the joint to provide at least two separate, interlocked links.

16 Claims, 7 Drawing Figures

METHOD OF MAKING CHAIN

This invention relates to the manufacture of chains and more particularly to a method of casting chains.

In the prior art, there are several conventional methods used in the commercial manufacture of chains for heavy duty purposes. Such methods include forming and welding, casting and combinations of casting and welding. In the forming and welding method, the links are formed as opened, C-shaped links, interlocked and then welded closed to form a chain. In the strictly casting method, a set of links are precast separately as closed links, the precast links are placed in mold cavities and interconnecting links are cast interlocking successive precast links. In the combination casting and welding method, closed and open, C-shaped links are formed by casting, the cast closed and open links are interlocked and the open links are welded closed to complete the chain. Generally, the casting method of making chains has the most advantages and thus is the preferred method used commercially in the manufacture of chain.

Although the cast method of making chain has several desirable advantages, it has the distinct disadvantage of providing core sand thicknesses between the mold cavities for the precast links and the mold cavities for the links to be cast which are very thin, creating a difficult foundry problem. Such walls not only are difficult to form but are susceptible to collapse during normal handling of the sand mold cores. It thus has been found to be desirable to provide an improved method of casting chains with the links interlocked while avoiding the difficulties incurred in the use of thin sand core walls between adjacent mold cavities.

Accordingly, it is the principal object of the present invention to provide an improved method of manufacturing chain.

Another object of the present invention is to provide an improved method of casting chain.

A further object of the present invention is to provide a method of casting a chain which avoids normally encountered coring problems.

A still further object of the present invention is to provide an improved method of casting a chain in which a number of interlocked chain links are cast in a single pour.

Another object of the present invention is to provide an improved method of casting chain in which a comparatively simple core arrangement is used.

A further object of the present invention is to provide an improved method of making chain which involves a comparatively minimal number of steps.

Other objects and advantages of the present invention will become more apparent to those persons having ordinary skill in the art to which the present invention pertains from the following description taken in conjunction with the accompanying drawings wherein.

Figure 1:
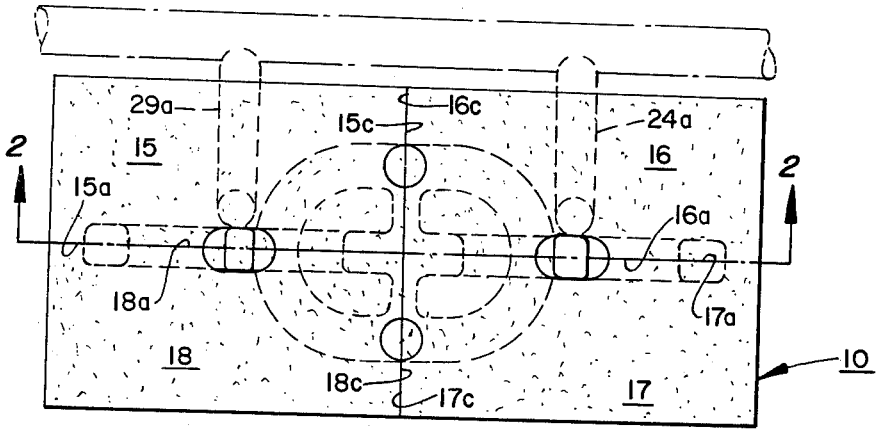
FIG. 1 is a top plan view of a sand mold suitable for use in practicing the method of the present invention.
Figure 4:
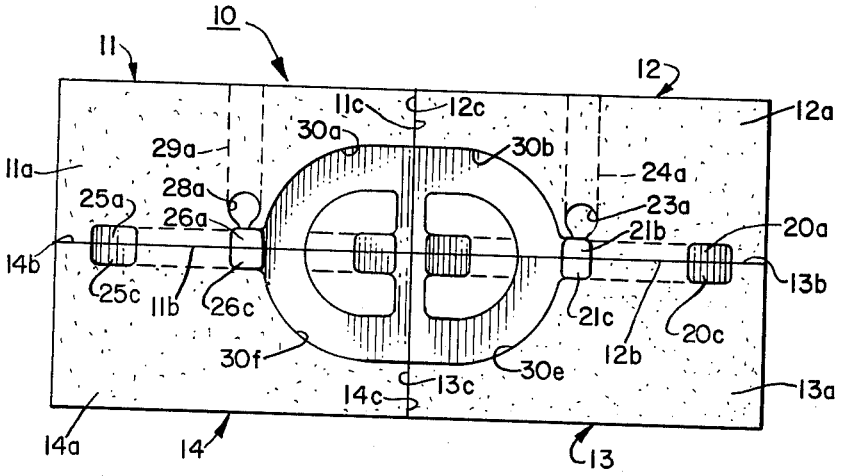
FIG. 4 is a cross-sectional view taken along line 4—4 in FIG. 2.
Figure 2:
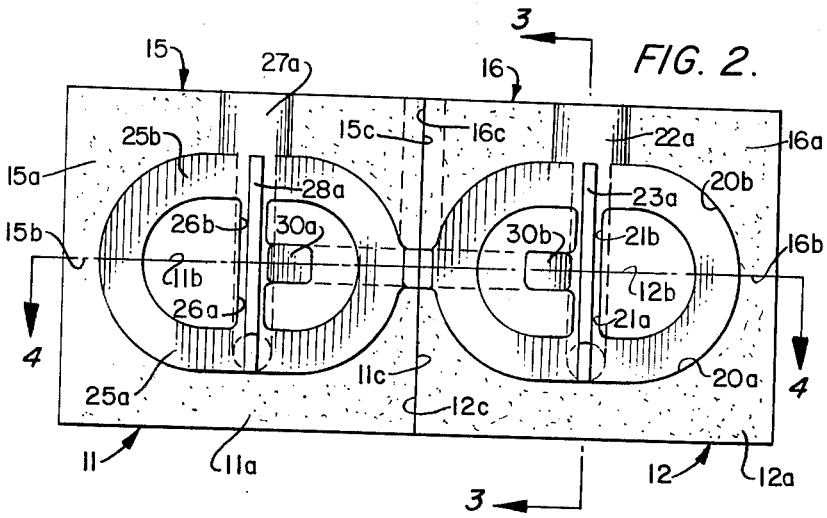
FIG. 2 is a cross-sectional view taken along line 2—2 of FIG. 1.
Figure 3:
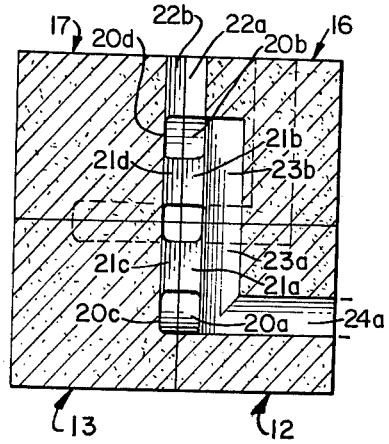
FIG. 3 is a cross-sectional view taken along line 3—3 of FIG. 2.

Briefly described, the present invention relates to a method of casting a chain generally consisting of forming a cavity in a mold including a pair of chain link portions disposed in a first plane, preferably in a vertical plane, and spaced apart, and a chain link portion disposed in a second plane at an angle to the plane of the set of chain link portions, preferably in a horizontal plane, interlocking the set of chain link portions, the single chain link portion communicating with both of the set of chain link portions to form at least two joints between the single chain link portion and the set of chain link portions, pouring the metal into the cavity to form a casting consisting of a set of three links joined together, permitting the metal to solidify, removing the integral set of links from the mold, removing the flash, headers, gates and risers from the casting, and then separating the chain link portions of the casting to provide a set of links interlocked to form a chain.

Referring to FIGS. 1 through 5 of the drawings, there is illustrated a mold 10 from which a chain, as described, can be cast. The mold consists of cores 11 through 18. Cores 11 through 14 may be assembled together to form the drag section of a sand box construction and cores 15 through 18 may be assembled together to form the cope section of the sand box construction.

Figure 5:
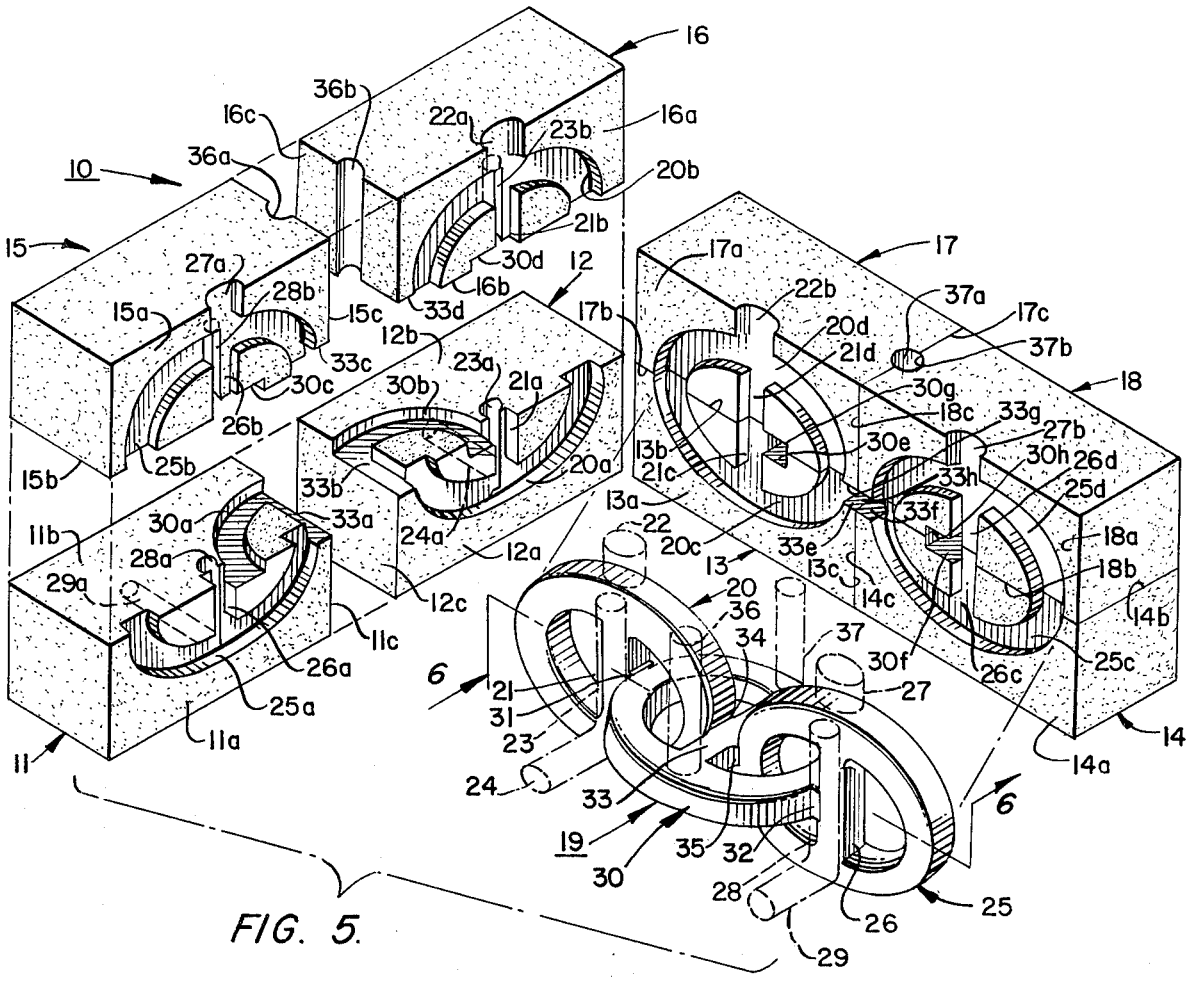
FIG. 5 is a perspective view of the mold shown in FIGS. 1 through 4, illustrating the cores of the mold in partially exploded relation and further illustrating a casting formed in such mold.

Referring to FIG. 5, it will be seen that cores 11 through 18 may be assembled together in a sand box construction to provide a cavity with appropriate headers, gates and risers to produce a casting 19 consisting of a first vertically disposed link 20 having a stud portion 21 provided with a header portion 22, a riser portion 23 and a gate portion 24, a second vertically disposed link 25 having a stud portion 26, a header 27, a riser 28, and a gate 29, and a horizontally disposed link 30 interconnecting links 20 and 25, having outer ends cast integrally with stud portions 21 and 26 of links 20 and 25, respectively, through joints 31 and 32, a stud portion 33 cast integrally with the outer ends of links 20 and 25 through joints 34 and 35, and a set of headers 36 and 37.

To form casting 19, cores 11 through 18 are provided with cavity portions formed on their adjoining surfaces which cooperate when the cores are assembled together in the box construction to provide a cavity having appropriate headers, gates and risers through which metal may be poured. In particular, core 11 is provided with adjoining surfaces **11*a*, 11*b*, and 11*c* having cavity portions 25*a* and 26*a* formed in surface 11*a*, cavity portion 30*a* formed in surface 11*b*, and cavity portion 33*a* formed in surfaces 11*b* and 11*c*. Core 11 further is provided with a riser cavity portion 28*a* which communicates with cavity portion 26*a* and a gate cavity portion 29*a* which intercommunicates the lower end of riser cavity portion 28*a* and the exterior of core 11. Core 12 is provided with adjoining surfaces 12*a*, 12*b* and 12*c*, having cavity portion 20*a* and 21*a* formed in surface 12*a*, cavity portion 30*b* formed in surface 12*b*, and cavity portion 33*b* formed in core surfaces 12*b* and 12*c*. Core 12 further is provided with riser cavity portion 23*a* communicating with cavity portion 21*a* and gate cavity portion 24*a*, intercommunicating the lower end of riser cavity portion 23*a* and the exterior of core 12**.

Core 15 is provided with adjoining surfaces 15*a*, 15*b* and 15*c*, having cavity portions 25*b*, 26*b* and 27*a* formed in core surface 15*a*, cavity portion 30*c* formed in core surface 15*b* and cavity portion 33*c* formed in core surfaces 15*b* and 15*c*. Core surface 15*c* is provided with a header cavity portion 36*a*. In addition, core 15 is provided with riser cavity portion 28*b* which communicates with cavity portion 26*b*. Core 16 is provided with adjoining surfaces 16*a*, 16*b* and 16*c*, having cavity portions 20*b*, 21*b* and 22*a* formed in surface 16*a*, cavity portion 30*d* formed in core surface 16*b*, cavity portion 33*d* formed in core surfaces 16*b* and 16*c* and header cavity portion 36*b* formed in core surfaces 16*c*. In addition, core 16 is provided with riser cavity portion 23(*b*) which communicates with cavity portion 21(*b*).

Core 13 is similar in configuration to core 12 and includes adjoining surfaces 13*a*, 13*b* and 13*c* having cavity portions 20*c* and 21*c* formed in the core surface 13*b*, cavity portion 30*e* formed in core surface 13*b* and cavity portion 33*e* formed in core surfaces 13*b* and 13*c*. Core 14 includes core surfaces 14*a*, 14*b* and 14*c* having cavity portions 25*c* and 26*c* formed in surface 14*a*, cavity portion 30*f* formed in core surface 14*b* and cavity portion 33*f* formed in core surfaces 14*b* and 14*c*.

Core 17 is similar in configuration to core 16 and is provided with core surfaces 17*a*, 17*b* and 17*c* having cavity portions 20*d*, 21*d* and 22*b* formed on core surface 17*a*, cavity portion 30*g* formed on cavity surface 17*b*, cavity portion 37*a* formed on core surface 17*b* and 33*g* formed on core surfaces 17*b* and 17*c*.

Similarly, core 18 is provided with adjoining surfaces 18*a*, 18*b* and 18*c* having cavity portions 25*d*, 26*d* and 27*b* formed on core surface 18*a*, cavity portion 30*h* formed in core surface 18*b*, cavity portion 37*b* formed on core surface 18*c* and cavity portion 33*h* formed on core surfaces 18*b* and 18*c*.

It will be appreciated that when the cores are assembled together, cavity portions 20*a* through 20*d* and 21*a* through 21*d* will co-operate to form a cavity for casting link 20, cavity portions 25*a* through 25*d* and 26*a* through 26*d* will co-operate to form a cavity for casting link 25, and cavity portions 30*a* through 30*h* and 33*a* through 33*h* will co-operate to form a cavity for casting link 30, interlocking links 20 and 25 with link 30 being cast integrally with links 20 and 25 through joints 31, 32, 34 and 35. Furthermore, cavity portions 22*a* and 22*b* will co-operate to form a header cavity, cavity portions 36*a* and 36*b* will co-operate to form a riser cavity and cavity 37*a* and 37*b* will co-operate to form another riser cavity. It further will be appreciated that as molten metal is poured through the header cavities, it will readily flow through the cavities for forming links 20 and 25 and through the passageways forming joints 31, 32, 34 and 35 to facilitate the formation of interlocking link 30.

Figure 6:
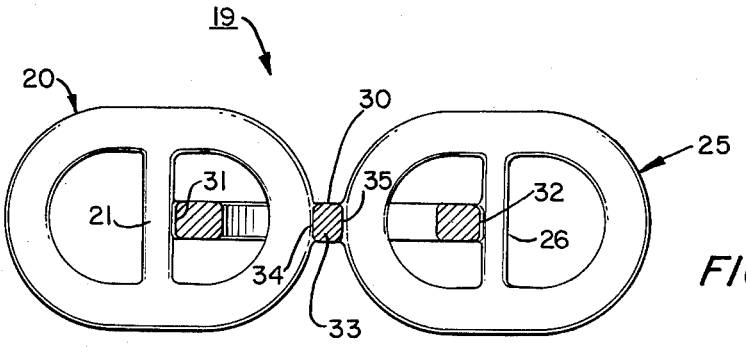
FIG. 6 is an enlarged cross-sectional view taken along line 6—6 in FIG. 5.
Figure 7:
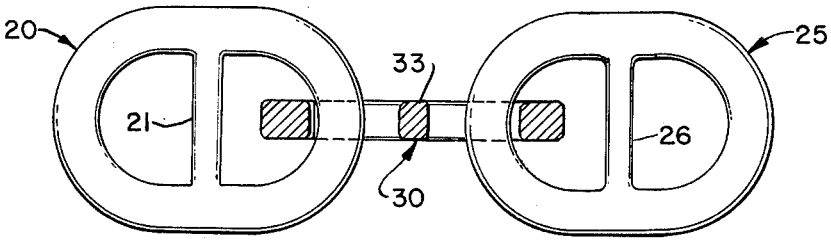
FIG. 7 is a view similar to the view shown in FIG. 6, illustrating the link portions severed to form a chain.

After casting 19 has been poured and permitted to cool, headers 22 and 27, risers 21, 28, 36 and 37 and gates 24 and 29 are moved by conventional means to provide a clean casting as shown in FIG. 6. Links 20, 25 and 30 are then separated along joints 31, 32, 34 and 35 by flame cutting to provide the chain shown in FIG. 7, having link 30 interlocking links 20 and 25. The finished chain may then be heat treated to impart the desired metallurgical properties to the chain. For heavy-duty applications such as in chains used with buckets of draglines, the chain often is cast from a maganese chromium molybdenum steel and depth hardened to make the chain links abrasive resistant and to make the links ductile for preventing fracture under low temperature conditions.

Although the method as described specified the use of chain links provided with studs for reinforcing purposes, it will be appreciated that chains without reinforcing studs can be made in accordance with the present invention. In lieu of joining the interlocking links as described, the links may be joined along inner surfaces of successive links which may be severed to provide the final chain. It also will be appreciated that other types of core arrangements can be utilized in practicing the invention. In addition, it will be seen that any number of chain links can be cast together to form a chain, limited only by equipment sizes and metallurgical considerations. The lengths of the chains produced by the present method also can be increased by the use of welded interconnecting links.

From the foregoing detailed description, it will be evident that there are a number of changes, adaptations and modifications of the present invention which fall within the province of those persons having skill in the art to which the aforementioned pertains. However, it is intended that all such variations not departing from the spirit of the invention be considered as within the scope thereof as limited solely by the appended claims.

I claim:

1. A method of making a chain comprising casting at least two links integrally so that the two links interlock and are joined together, and then severing said links along said joint to provide at least two separate, interlocked links.

2. A method according to claim 1 wherein said links are severed by flame cutting.

3. A method according to claim 1 wherein said links are cast 90° apart.

4. A method according to claim 1 wherein said joint is formed along inner surfaces of said links.

5. A method according to claim 4 wherein said links are severed by flame cutting.

6. A method according to claim 4 wherein said links are cast 90° apart.

7. A method according to claim 4 wherein said joint is formed along inner surfaces of said links normally engaging when said links are severed and said chain is drawn taut.

8. A method according to claim 1 wherein each link is formed with a stud and said joint is formed along an outer surface of one link and a stud of a successive link.

9. A method according to claim 8 wherein said links are severed by flame cutting.

10. A method according to claim 8 wherein said links are cast 90° apart.

11. A method according to claim 1 wherein each link is formed with a stud, the stud of a first interlocking link is formed integrally through a first joint with a main body portion of a second interlocking link and a stud of the second interlocking link is formed integrally through a second joint with the main body portion of the first interlocking link.

12. A method according to claim 11 wherein said links are severed by flame cutting along said joints.

13. A method according to claim 11 wherein said links are cast 90° apart.

14. A method according to claim 14 wherein the stud of said first link is formed integrally with an outer surface of the main body portion of said second link to form said first joint, and an outer surface of said first link is formed integrally with the stud of said second link to form said second joint.

15. A method according to claim 14 wherein said links are severed by flame cutting along said joints.

16. A method according to claim 14 wherein said links are cast 90° apart.

* * * * *